US006168023B1

(12) United States Patent
Cooper

(10) Patent No.: US 6,168,023 B1
(45) Date of Patent: Jan. 2, 2001

(54) CADDY SHAVER RECEPTACLE FOR SHAVING ITEMS AND INSTRUMENTS

(76) Inventor: Anthony M. Cooper, 7575 Becker Ct., Jonesboro, GA (US) 30236

( * ) Notice: Under 35 U.S.C. 154(b), the term of this patent shall be extended for 0 days.

(21) Appl. No.: 09/294,070

(22) Filed: Apr. 19, 1999

(51) Int. Cl.[7] ..... B65D 69/00

(52) U.S. Cl. ..... 206/581; 206/228; 206/823; 132/290

(58) Field of Search ..... 206/352, 354, 206/228, 581, 361, 823, 229; 30/34.05, 40, 40.2, 41.7; 132/289, 290, 292, 313

(56) References Cited

U.S. PATENT DOCUMENTS

| | | | | |
|---|---|---|---|---|
| 1,498,302 | | 6/1924 | Satake . | |
| 1,887,124 | | 11/1932 | Flintermann . | |
| 1,981,674 | | 11/1934 | Solomon . | |
| 2,022,508 | * | 11/1935 | Hoddersen | 132/289 |
| 2,949,203 | | 8/1960 | Berg . | |
| 3,026,998 | | 3/1962 | Scully . | |
| 3,272,323 | | 9/1966 | Ewry . | |
| 3,486,630 | | 12/1969 | Ellman . | |
| 3,754,326 | | 8/1973 | Glaberson . | |
| 4,141,445 | | 2/1979 | Korich . | |
| 4,144,967 | | 3/1979 | Craven . | |
| 4,232,795 | | 11/1980 | Lucas . | |
| 4,320,832 | | 3/1982 | Edstrom . | |
| 4,656,738 | | 4/1987 | Corah . | |
| 4,856,647 | | 8/1989 | Dahne . | |
| 4,888,868 | | 12/1989 | Pritchard . | |
| 5,018,543 | * | 5/1991 | Trillo Martinez et al. | 132/289 |
| 5,738,122 | * | 4/1998 | Armbrushter et al. | 132/290 |
| 5,806,669 | * | 9/1998 | Kim | 206/349 |

FOREIGN PATENT DOCUMENTS

| | | |
|---|---|---|
| 181363 | 7/1922 | (GB) . |
| 2 151918A | 7/1985 | (GB) . |

* cited by examiner

*Primary Examiner*—Paul T. Sewell
*Assistant Examiner*—Luan K. Bui

(57) ABSTRACT

The present invention is a single cavity unit particularly constructed to accommodate all items and instruments necessary to complete the process of shaving, but not attaching itself to any of the items or instruments. This is accomplished by having accommodations, made onto and as part of the single cavity unit, to hold the shaving razor, shaving can, applicator brush, and shaving blade cartridge. Varying shaving can sizes are accommodated by the single cavity unit.

2 Claims, 2 Drawing Sheets

CADDY SHAVER RECEPTACLE FOR SHAVING ITEMS AND INSTRUMENTS

BACKGROUND AND FIELD OF THE INVENTION

The present invention relates to a caddy shaver that is able to sit stationary and accommodate different items and instruments needed to complete the process of shaving.

SUMMARY OF THE INVENTION

The present invention relates to a caddy shaver that has non-detachable external accommodations for a shaving razor, applicator brush, shaving can, and blade cartridge.

DETAILED DESCRIPTION OF THE INVENTION

Figure 1:
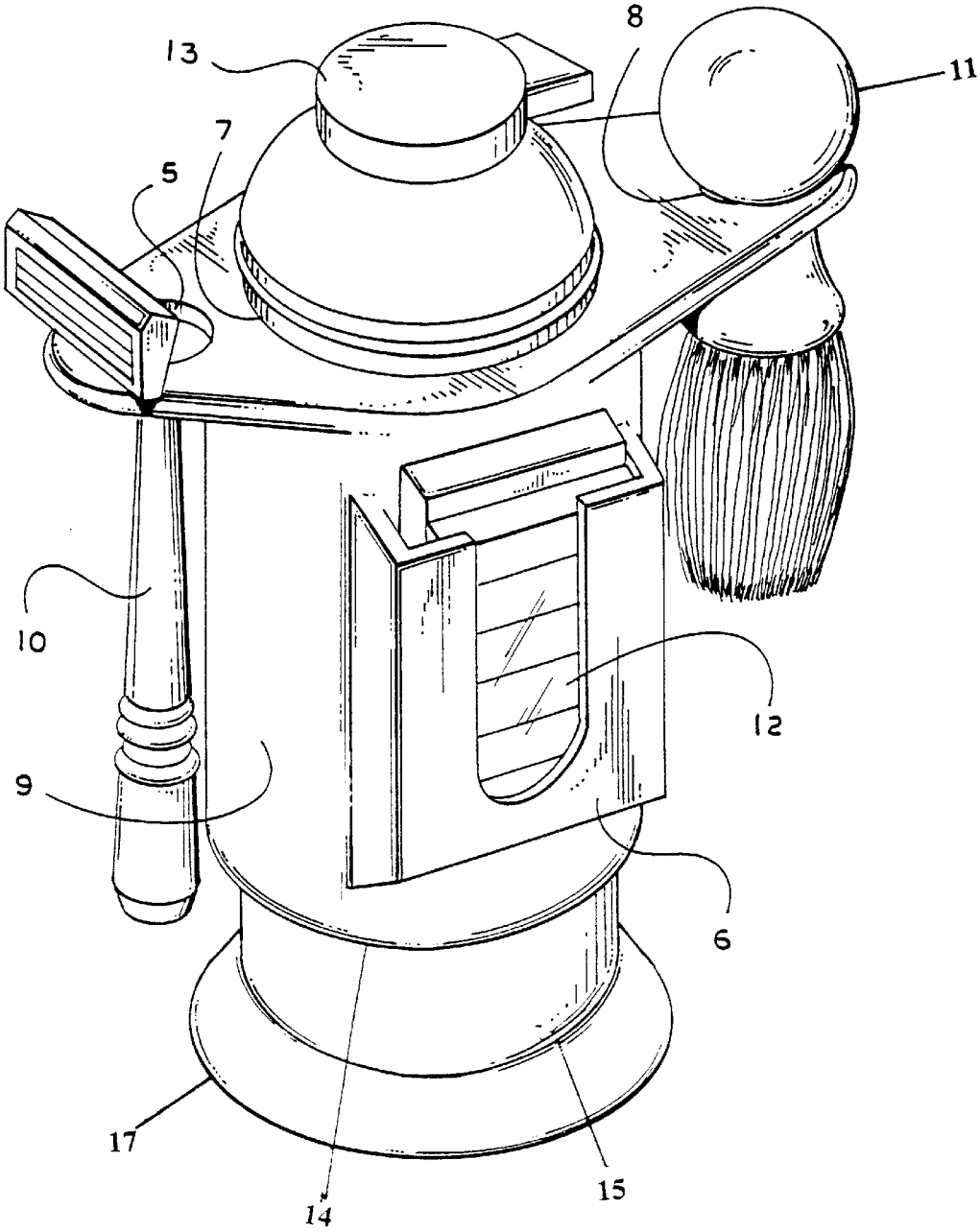
FIG. 1 illustrates a perspective view of the caddy shaver of the present invention.
Figure 2:
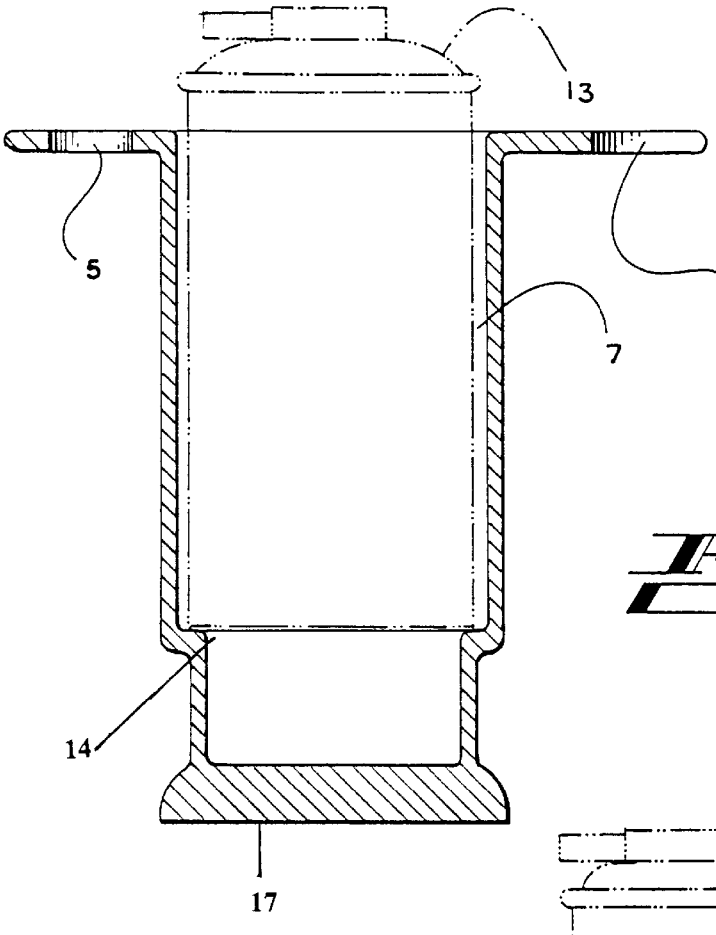
FIG. 2 is a cross sectional rear view of FIG. 1, illustrating a wide aerosol shaving cream can 13 inserted into the caddy shaver 9 and a neck for supporting the can.
Figure 3:
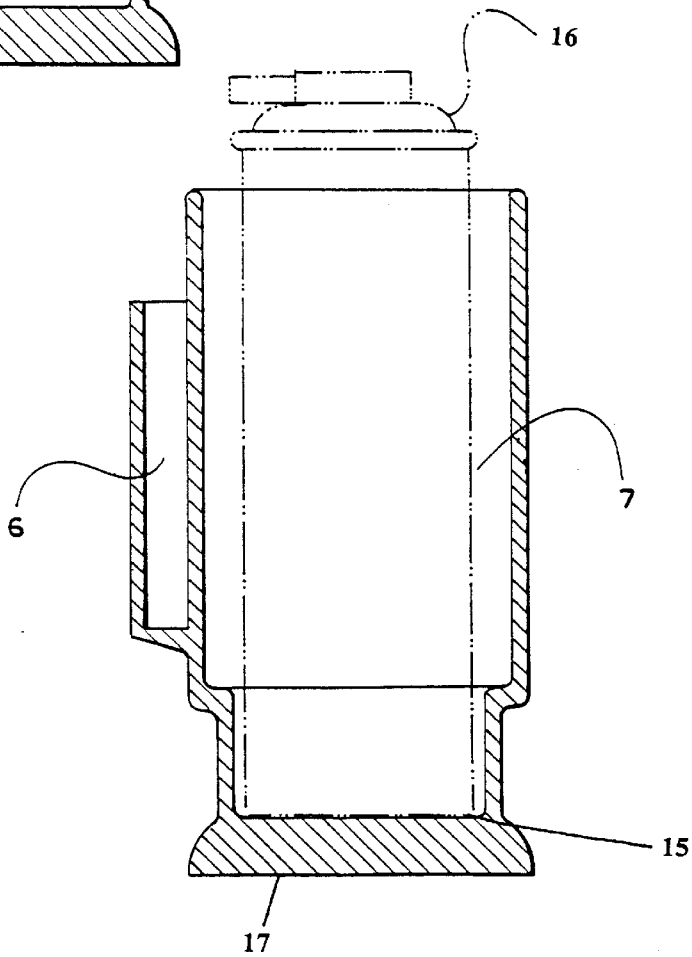
FIG. 3 is a cross sectional side view of FIG. 1, illustrating a slimmer shaving cream can 16 inserted further into the caddy shaver 9.

FIGS. 1–3 show a caddy shaver receptacle is a single unit for holding shaving items and instruments used to complete the process of shaving. The caddy shaver including a body (9) having a cavity (7) for accommodating a plurality of sizes of shaving cream cans. The cavity includes a wide upper area (14) and a neck (15). The neck has a diameter being narrower than a diameter of the upper area, so the cavity can accommodate various sizes of shaving cream cans by allowing a slimmer shaving cream can (16) to slide to the neck of the cavity which supported by the base but stopping a wider shaving cream can (13) before the wider shaving cream can can reach the base. A flat base (17) for allowing the caddy shaver to maintain an upright stationary position. A first extension extends from the body and includes a hole (5) adapted to hold a shaving razor (10). A second extension extends from the body opposite the first extension and includes a slot (8) adapted to hold a shaving brush (11). A protrusion (6) disposed on the body for accommodating a shaving blade cartridge (12) having a slot therein.

What is claimed:

1. A caddy shaver for holding shaving items and instruments, the caddy shaver comprising:

a body (9) having a cavity (7) for accommodating a plurality of sizes of shaving cream cans (13, 16), a flat base (17) for allowing the caddy shaver to maintain an upright stationary position, a first extension which includes a hole (5) adapted and sized to hold a shaving razor (10), a second extension opposite the first extension which includes a slot (8) adapted and sized to hold a shaving brush (11), and a protrusion (6) on the side between the extensions adapted and sized for accommodating a shaving blade cartridge (12); and the cavity comprising a wide upper area (14) and a neck (15); the neck has a diameter being narrower than a diameter of the upper area; wherein the cavity accommodates various sizes of shaving cream cans, by allowing a slimmer shaving cream can (16) to slide to the neck of the cavity and be supported by the base but stopping a wider shaving cream can (13) before the wider shaving cream can can reach the base.

2. The caddy shaver as recited in claim 1, wherein the protrusion further comprises a slot for viewing the shaving blade cartridge disposed within the protrusion.

* * * * *